US010927511B2

(12) United States Patent
Dellario

(10) Patent No.: US 10,927,511 B2
(45) Date of Patent: Feb. 23, 2021

(54) SELF-LUBRICATING HAND TAMPER

(71) Applicant: Michael S. Dellario, Middleport, NY (US)

(72) Inventor: Michael S. Dellario, Middleport, NY (US)

( * ) Notice: Subject to any disclaimer, the term of this patent is extended or adjusted under 35 U.S.C. 154(b) by 70 days.

(21) Appl. No.: 16/546,704

(22) Filed: Aug. 21, 2019

(65) Prior Publication Data

US 2020/0063383 A1 Feb. 27, 2020

Related U.S. Application Data

(60) Provisional application No. 62/723,208, filed on Aug. 27, 2018.

(51) Int. Cl.
*E01C 19/32* (2006.01)

(52) U.S. Cl.
CPC ..... *E01C 19/32* (2013.01)

(58) Field of Classification Search
CPC ..... E01C 19/32; E01C 19/43
USPC ..... 404/130, 133.05, 133.1
See application file for complete search history.

(56) References Cited

U.S. PATENT DOCUMENTS 1,007,536 A 10/1911 Cooley
2,841,061 A * 7/1958 Starr ..... E01C 19/32 404/133.1
2,870,696 A * 1/1959 Yoch ..... E02D 3/046 404/133.1
2,884,842 A * 5/1959 Schmitz ..... E01C 19/35 404/133.1
3,117,378 A * 1/1964 Bowen ..... G01C 15/06 33/293
4,082,471 A * 4/1978 Hiszpanski ..... E02D 3/068 173/207
4,231,677 A * 11/1980 Roming ..... B44B 11/02 404/89
6,109,365 A * 8/2000 Lamoureux ..... A01B 1/02 173/128
D531,863 S * 11/2006 Irwin ..... E01C 19/43 D8/1
D561,543 S * 2/2008 Callander ..... E01C 19/43 D8/14
7,387,466 B2 * 6/2008 Irwin ..... E01C 19/43 404/133.05
7,740,416 B2 * 6/2010 Lesche ..... E01C 19/32 404/133.1
9,493,917 B2 * 11/2016 Lesche ..... E02D 3/046
9,777,444 B1 10/2017 Dellario
9,828,738 B2 * 11/2017 Myrland ..... E01C 19/32

* cited by examiner

*Primary Examiner* — Raymond W Addie
(74) *Attorney, Agent, or Firm* — Hodgson Russ LLP

(57) ABSTRACT

A hand tamper includes a handle and a tamping head. The handle has a cavity to hold a fluid. The tamping head includes apertures in the bottom. Fluid can flow from the handle through the apertures of the tamping head to coat a tamping surface on the bottom of the hand tamper. The fluid can, for example, prevent asphalt from sticking to the tamping head.

11 Claims, 4 Drawing Sheets

SELF-LUBRICATING HAND TAMPER

CROSS-REFERENCE TO RELATED APPLICATIONS

This application claims priority to the provisional patent application filed Aug. 27, 2018 and assigned U.S. App. No. 62/723,208, the disclosure of which is hereby incorporated by reference.

FIELD OF THE DISCLOSURE

This disclosure relates to hand tools and, more particularly, to hand tampers.

BACKGROUND OF THE DISCLOSURE

When working with asphalt, workers typically compact or level material with a hand tamper. However, when tamping asphalt, fresh asphalt will stick to the tamper, requiring workers to constantly clean off the tamper. Failure to remove the asphalt from the tamper will increase the weight of the tamper, which increases lifting effort by a user. Asphalt stuck to the bottom of the tamper also can affect the ability to create a smooth surface on the asphalt. Workers may try to prevent asphalt from sticking to a tamper by applying a release agent to the tamper. However, applying the release agent to the tamper can be time-consuming and carrying a separate container for the release agent can be cumbersome. Furthermore, the release agent may be stored a distance from the worker, which requires that the worker stop working and navigate to the release agent without stepping on the fresh asphalt.

Therefore, a hand tamper having an integral method of storing and applying a release agent is needed.

BRIEF SUMMARY OF THE DISCLOSURE

A hand tamper is disclosed in a first embodiment. The hand tamper comprises a handle, a tamping head, and a valve. The handle defines a cavity, an inlet in fluid communication with the cavity, and an outlet in fluid communication with the cavity. The inlet and the outlet are disposed on opposite ends of the handle. The tamping head is disposed on one of the ends of the handle. The tamping head is in fluid communication with the outlet and includes a support member disposed on the handle and a tamping plate disposed on the support member. The support member defines a bore configured to receive the handle. The tamping plate defines from two to six apertures through the tamping plate in fluid communication with the bore. Each of the apertures has a diameter from ⅛ inch to 5/32 inch. The valve is disposed in the handle. The valve is configured to control fluid flowing from the cavity in the handle to the tamping head.

The inlet may be disposed on a proximal end of the handle and the outlet may be disposed on a distal end of the handle. The cavity can be disposed between the inlet and the outlet.

The cavity can be configured to hold at least a quart of fluid.

The tamping head can be fabricated entirely of aluminum, magnesium, cast iron, steel, or an alloy thereof.

The hand tamper can include an activator connected to the valve. The activator is disposed on the handle. The activator may be disposed more proximate to the outlet of the handle than the inlet of the handle.

The tamper head can be configured to connect with the handle using a screw connection. The handle can be configured to be disconnected from the tamping head.

A seal can be formed between the handle and the support member.

The tamping plate can define four of the holes.

At least part of an exterior surface of the tamping head can include a non-stick coating.

DESCRIPTION OF THE DRAWINGS

For a fuller understanding of the nature and objects of the disclosure, reference should be made to the following detailed description taken in conjunction with the accompanying drawings, in which.

DETAILED DESCRIPTION OF THE DISCLOSURE

Although claimed subject matter will be described in terms of certain embodiments, other embodiments, including embodiments that do not provide all of the benefits and features set forth herein, are also within the scope of this disclosure. Various structural and process step changes may be made without departing from the scope of the disclosure. Accordingly, the scope of the disclosure is defined only by reference to the appended claims.

Embodiments of the hand tamper disclosed herein include a reservoir disposed in the handle. The reservoir can dispense a fluid, such as a release agent, onto a surface of the tamper. This can prevent asphalt buildup on the tamper, which provides convenience, provides a smoother asphalt surface, and improves efficiency when compacting or otherwise working with asphalt.

Figure 1:
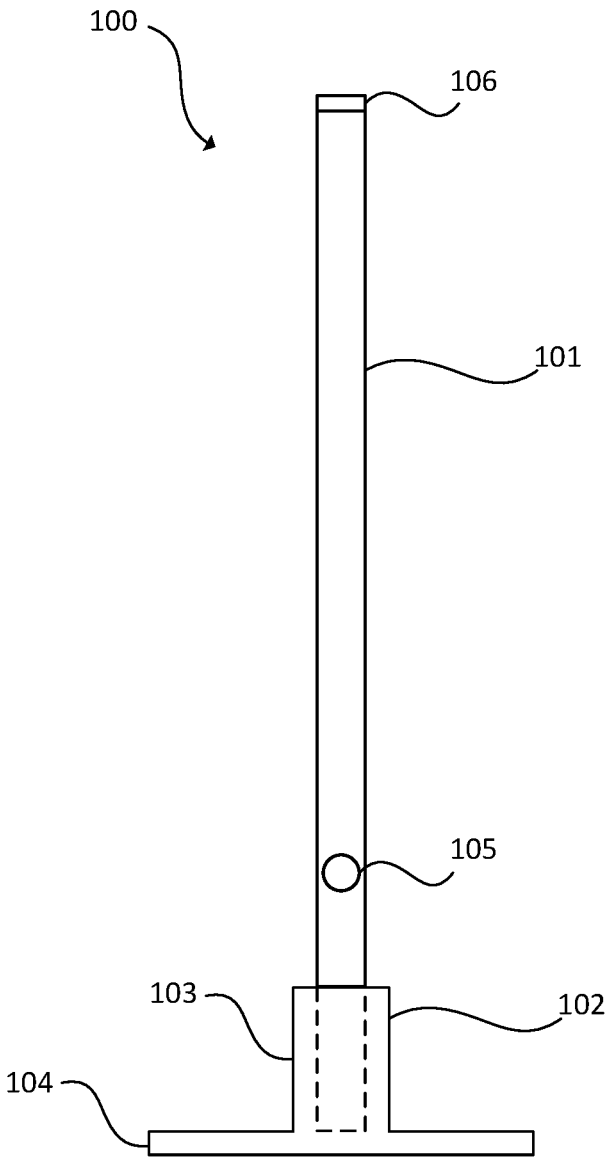
FIG. 1 shows a side view of an embodiment of the self-lubricating hand tamper in accordance with the present disclosure.
Figure 2:
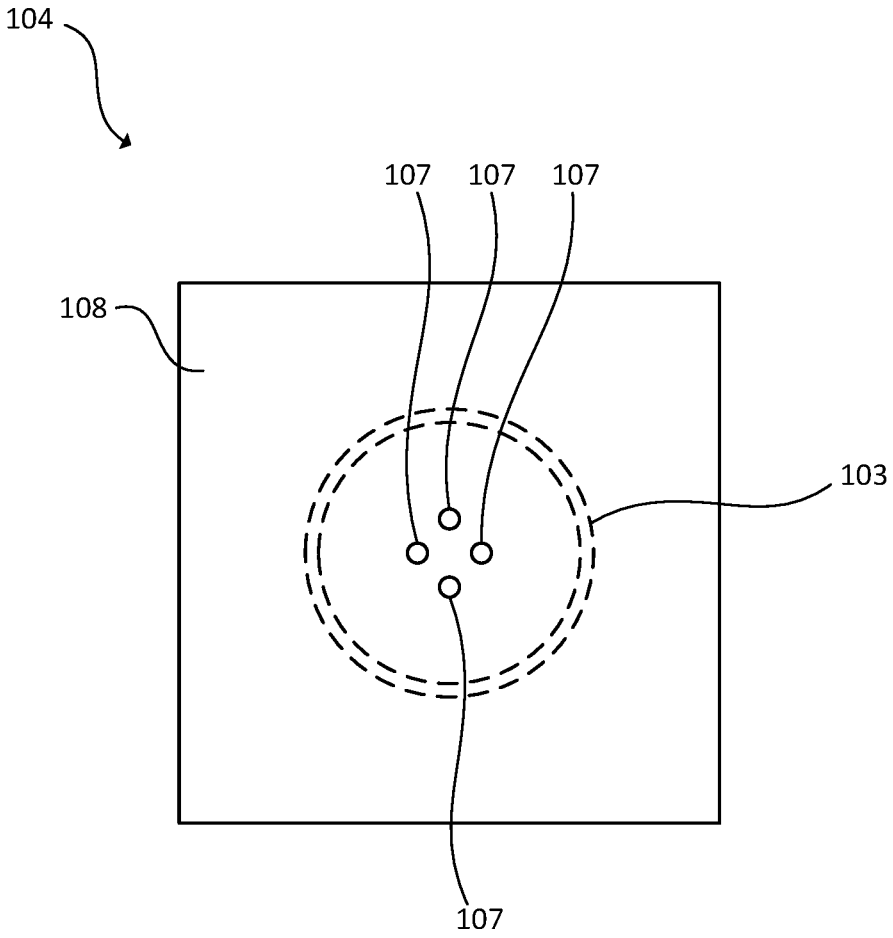
FIG. 2 shows a bottom view of the tamping head of FIG. 1.

FIG. 1 shows a side view of an embodiment of the self-lubricating hand tamper 100 and FIG. 2 shows a bottom view of the tamping head 102 of FIG. 1. A self-lubricating hand tamper 100 lubricates the tamping plate 104 of the hand tamper 100. The hand tamper 100 includes a handle 101 and a tamping head 102. The tamping head 102 is disposed on one of the ends of the handle 101. The handle 101 includes a reservoir to hold a fluid, such as a release agent. The hand tamper 100 also can include a cap 107.

The tamping head 102 includes a support member 103 disposed on the handle 101. The support member 103 defines a bore configured to receive the handle 101 (as shown by the dotted lines in FIG. 1). The bore does not extend entirely through the tamping head 102. The tamping head 102 also includes a tamping plate 104. The tamping plate 104 is disposed on the support member 103, such as being formed integrally with the support member 103. Thus, the support member 103 and the tamping plate 104 can be the same piece. The tamping plate 104 has a tamping surface 108 (opposite the support member 103) that primarily contacts asphalt or other materials when the hand tamper 100 is in use. The tamping surface 108 can be considered the bottom of the hand tamper 108.

The tamping plate 104 defines from two to six apertures 107 through the tamping plate 104. The apertures 107 are in fluid communication with the bore of the support member 103. In an instance, the apertures 107 extend through the tamping plate 104. The two to six apertures 107 can provide desired fluid flow through the apertures 107 without excessive clogging. The embodiment of FIG. 2 illustrates four of the apertures 107. The apertures 107 can be arranged in a circular or polygonal pattern around a center of the tamping plate 104. The apertures 107 can be positioned inside an inner diameter of the bore of the support member 103. More than six apertures 107 or only one aperture 107 also are possible.

Each of the apertures 107 can have a diameter from approximately ⅛ inch to 5/32 inch (i.e., 3.175 mm to 3.969 mm). This range in diameters can enable easy cleaning without leaving a noticeable imprint on the asphalt. An aperture 107 with a larger diameter can leave an imprint on the asphalt during use. An aperture 107 with a larger diameter also can clog with stones or large pieces of asphalt, which can be difficult to remove. An aperture 107 with a smaller diameter can have reduced fluid flow and can be difficult to clean, especially if clogged with small asphalt particles, dirt, sand, or other small particles. The apertures 107 can be drilled out to remove debris clogging the apertures 107, but this can be challenging for apertures 107 with diameters less than ⅛ inch due to size constraints. This also can be challenging for apertures 107 larger than 5/32 inch due to the force that may be required to eliminate large debris. Apertures 107 with a diameter from ⅛ inch to 5/32 inch can provide a desired fluid flow and can be easy to clean, such as with a nail, screwdriver, drill, stick, or other object.

The hand tamper 100 also includes an activator 105 disposed in the handle 101. The activator 105 is configured to control fluid flowing from a cavity in the handle 101 to the tamping head 102. The activator 105 can be disposed more proximate to the outlet of the handle 101 connected with the tamping head 102 than an inlet on the opposite side of the handle 101. This position of the activator 105 can prevent the activator 105 from being unintentionally adjusted during operation and can prevent the activator 105 from impeding grip by a user during operation. However, the activator 105 can be positioned elsewhere on the handle 101 than as illustrated in FIG. 1.

Figure 3:
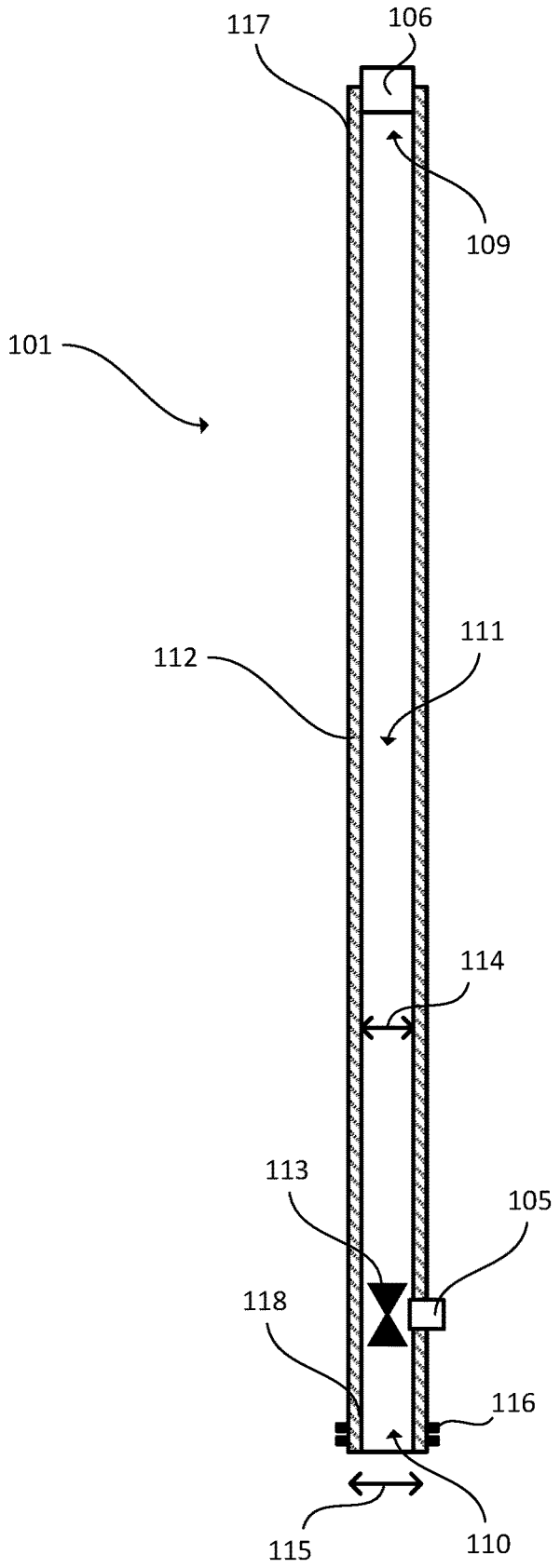
FIG. 3 is a cross-sectional view of an embodiment of a handle in accordance with the present disclosure.

FIG. 3 is a cross-sectional view of an embodiment of a handle 101 with the proximal end 117 and distal end 118. As seen in FIG. 3, a cap 107 is positioned in the inlet 109 at the proximal end 117. The outlet 110 is positioned at the distal end 118. A cavity 111 is formed by the walls 112 of the handle 101 and can be used as a reservoir for fluid, such as a release agent.

In an instance, the cavity 111 is the entire length of the handle, though other dimensions or configurations are possible. The cavity 111 may hold at least 1 quart of fluid. For example, the cavity 111 can hold approximately 1 quart or 1.5 quarts of fluid. Other volumes are possible.

A valve 113 is disposed in the handle 101. The valve 113 is connected to and controlled by the activator 105. The valve 113 is configured to control fluid flowing from the reservoir in the handle 101 to the tamping head 102. The valve 113 may be a butterfly valve, needle valve, or another type of valve. The activator 106 can be a knob, switch, or other device.

The valve 113 and/or activator 106 may be positioned in the handle 101 in a manner that maximizes the volume of the reservoir. Of course, the valve 113 and/or activator 106 can be positioned in a manner that reduces the volume of the reservoir to increase a user's comfort during operation or for other reasons. The valve 113 may be disposed more proximate to the outlet 110 of the handle 101 than the inlet 109 of the handle 101.

In an instance, the outer diameter 115 of the handle 101 can be from approximately 1.25 inches to 1.5 inches. The inner diameter 114 of the handle 101 can be from approximately 1.125 inches to 1.375 inches, with the inner diameter 114 being less than the outer diameter 115. The handle 101 may be approximately 48 inches to 50 inches long. Other diameters or lengths are possible. For example, different diameters or lengths may be used so that users with different heights, weights, or arm lengths can work comfortably.

In an instance, the handle 101 is fabricated of aluminum. However, the handle 101 can be PVC or other materials. The cap 107 may be fabricated of PVC, rubber, other plastics, or other materials.

The distal end 118 of the handle 101 with the outlet 110 can include a thread 116 for a connection with the tamping head 102. The thread 116 can be aluminum, an aluminum alloy, or other materials.

In another embodiment, the inlet 109 is in fluid communication with another fluid source, such as a larger container. For example, the inlet 109 may be connected to a hose that is connected to a bottle clipped to a user or a backpack with a storage tank worn by a user. This increases the amount of fluid that can be carried and reduces the frequency of refilling the handle 101.

While the valve 113 is disposed in the handle 101, the valve 113 also can be disposed in the tamping head 102. The activator 105 also can be disposed on the tamping head 102.

The distal end 118 also may be configured to receive a cap, which may be like the cap 107. This can prevent fluid spillage when the handle 101 is disconnected from a tamping head, such as a when changing tamping heads or during transport.

A fluid, such as release agent, can be poured into the inlet 109 of the handle 101. The cap 107, which may be configured to be screwed into the handle 101, may be used to seal the end of the handle 101 and prevent the fluid from leaking out during use of the hand tamper. A press fit, latch, or another sealing mechanism also can be used to seal the end of the handle 101 with the cap 107 and prevent the fluid from leaking out during use of the handle 101. Gaskets, O-rings, or other mechanisms can be used to improve the seal.

The inlet 109 for the fluid in the handle 101 may be a straight bore. The inlet in the proximal end 104 of the handle 101 also may be shaped to improve pouring or reduce spillage, such as by including a funnel.

Figure 4:
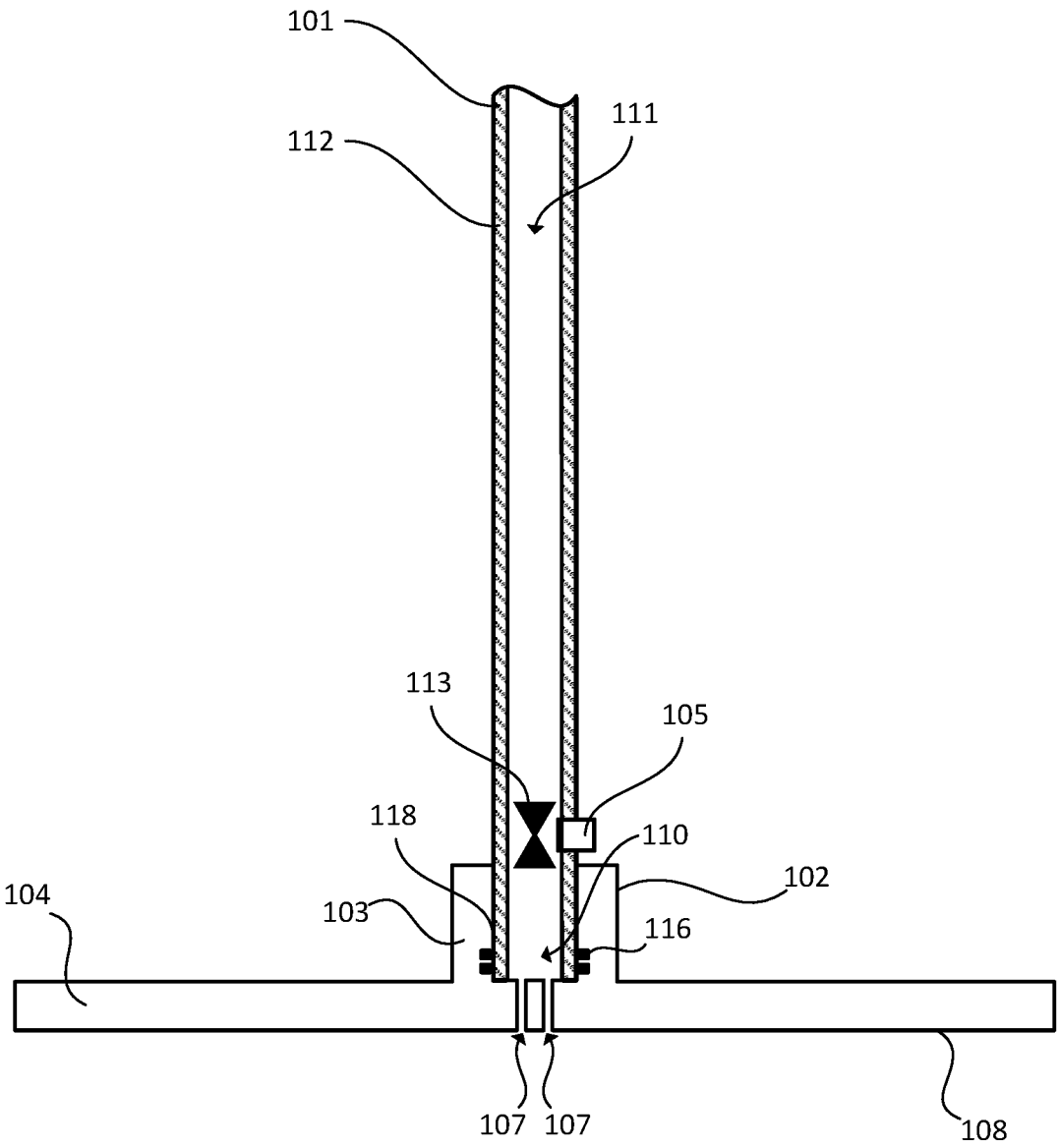
FIG. 4 shows a corresponding cross-sectional side view of an embodiment of the self-lubricating hand tamper of FIG. 1.

FIG. 4 shows a corresponding cross-sectional side view of an embodiment of the hand tamper 100 of FIG. 1. The tamping head 102 is disposed on the distal end 118 of the handle 101. The tamping head 102 is in fluid communication with the outlet 110 of the handle 101. As seen in FIG. 4, the handle 101 is received by the bore in the support member 103. The apertures 107 (two illustrated in FIG. 3, though other numbers are possible) are in fluid communication with the bore and, consequently, the outlet 110 of the handle 101.

The bottom of the bore in the support member 103 may be flat (as illustrated). The connection between the outlet 110 and the apertures 107 can provide the desired fluid flow. In another embodiment, the handle 101 rests on a shoulder in the bore of the support member 103. Thus, the bore may have different diameters. In another embodiment, the bottom of the bore of the support member 103 can be curved or rounded to direct fluid to the apertures 107.

Fluid flows out the outlet 110 of the handle 101 through the apertures 107. Fluid flow is governed by the valve 113.

While illustrated perpendicular to the direction of the handle 101, the apertures 107 also can be at different angles to provide desired fluid flow.

The walls 112 of the cavity 111 and the bore of the support member 103 can be straight, as illustrated in FIG. 3, but also can be angled or tapered.

The handle 101, may be screwed, press-fitted, latched, or otherwise connected to the support member 103. Thus, the walls of the bore in the support member 103 may include threaded grooves (e.g., a female connection). Use of a screw connection may enable a user to quickly connect and disconnect a handle 101 from the tamping head 102. A seal may be formed between the handle 102 and the support member 103, which reduces leaks. Gaskets, O-rings, or other mechanisms can be used to improve the seal.

The handle 101 may be temporarily connected to the support member 103, which enables the handle to be easily disconnected from the tamping head 102. For example, the handle 101 may be disconnected from the support member 103 to swap the handle between tamping heads. The handle also may be more permanently connected to the support member 103, such as using bolts, screws, welding, adhesive, or other fasteners. A more permanent connection may prevent leaks at the point of connection.

The tamping surface 108 may be relatively planar. Channels or grooves also may be formed in the tamping surface 108 to encourage or guide fluid flow. The channels or grooves may extend outward from proximate the apertures 107 toward an outer perimeter of the tamping surface 108.

In an embodiment, a series of internal channels in the tamping head 102 carry fluid from the handle 101. The internal channels may be positioned between the distal end 118 of the handle 101 to the tamping surface 108. These channels are formed in the interior of the support member 103 and tamping plate 104 and can serve as a distribution network in fluid communication with the handle 101. Thus, fluid can be delivered farther from the center of the tamping surface 108 or outside an inner diameter of the bore in the support member 103.

During use, a user can fill up the reservoir in the handle 101 with fluid, such as release agent, and then can control how much fluid is released onto the tamping plate 104 using the activator 105. A user can use the activator 105 to open the valve 113. Fluid will flow from the handle 101 to the tamping head 102. Fluid will exit through the apertures 107 onto the tamping surface 108. Gravity can cause the fluid to flow across the tamping surface 108 if the hand tamper 100 is tilted. A user may tilt the hand tamper 100 from side to side, rotate the hand tamper 100, or spin the hand tamper 100 such that the fluid flows across the tamping surface 108. Some or all of the tamping surface 108 may be wetted in this manner. This can reduce or prevent asphalt from sticking to the tamping surface 108 or the tamping plate 104. The user can apply fluid before and/or while working with asphalt, saving time and energy.

Gravity, surface tension, capillary action, or other mechanisms can provide a continuous stream of fluid onto the previously-wetted tamping surface 108. Thus, the valve 113 can be opened and fluid may continuously spread across the tamping surface 108 while a user is tamping.

A user can close the valve 113 using the activator 105 prior to tamping. The user also may leave the valve 113 open to provide a flow of fluid onto the tamping surface 108 while tamping. A user can close the valve 113 when switching tamping heads 102, refilling the handle 101, or storing the hand tamper 100.

In the embodiments disclosed herein, the tamping head can be wholly or partly fabricated of, for example, aluminum, magnesium, cast iron, steel, alloys thereof, wood, or other suitable materials. In a particular embodiment, the hand tamper is approximately 50 inches to 52 inches long from tamping surface 108 to the cap 107 or proximal end 117 of the handle 101. The tamping plate may have dimensions of approximately 8×8 inches, 10×10 inches, 6×8 inches, 6×10 inches, or other sizes. The exact size, construction, and design may vary with the type of material be tamped, user, or application.

Embodiments disclosed herein can hold a fluid, such as a release agent, in the reservoir of the handle and can release the fluid using a valve. For example, a knob may be disposed on or near the tamping head 102, which can enable a user to select how much fluid is needed for a particular job. The valve can control the amount of fluid that is dispensed or can entirely stop the fluid flow.

The fluid can be a release agent such as G-Slide (manufactured by L & L Quality Products), Bio Slide (manufactured by Bio Systems, Inc.), fuel oil, diesel fuel, or other lubricants. Other fluids may be used depending on the raking application. While not necessary, some users may select a fluid that has the lowest environmental impact and/or is biodegradable.

In an embodiment, at least part of the exterior surface of the tamping head 102 is coated with a non-stick coating. The non-stick coating may include, for example, polytetrafluoroethylene (PTFE), an electroless nickel compound, graphite, a polymer, molybdenum disulfide, or other materials. Such a coating may have a low coefficient of friction, which can reduce an amount of asphalt that sticks to the tamping head 102. The entire tamping head 102 may be coated with the non-stick coating, only the tamping plate 104 may be coated with the non-stick coating, only the tamping surface 108 may be coated with the non-stick coating, or other parts of the tamping head 102 may be coated with the non-stick coating.

While disclosed with respect to asphalt, embodiments disclosed herein can be applied to soil, gravel, or other materials.

Embodiments disclosed herein reduce or eliminate asphalt that sticks to the tamping head. This can improve efficiency because users are not constantly cleaning asphalt from the tamping head. For example, a user may need to clean the tamping head by heating and scraping less frequently. Jobs can be completed faster and with fewer interruptions. Furthermore, this can reduce stress on a user's arms or back because the hand tamper, without clumped asphalt, has less weight associated with it. For example, 1 lb. of asphalt or more may stick to the tamping head in the absence of lubrication. Balance of the hand tamper also may be improved without asphalt clumped to the tamping head, which may be more comfortable for a user.

Reducing asphalt buildup on the tamping head can improve the finished asphalt product. For example, a road or driveway will have a smoother final surface if the tamping head has less asphalt stuck to it.

Reducing asphalt buildup on the tamping head also can enable a user to work in colder weather. Asphalt typically sticks to a tamping head more in colder weather, which makes it more difficult to work.

As the fluid is dispensed directly to the tamping head and the fluid can be more safely poured into the reservoir, exposure by a user to the fluid is reduced. For example, the fluid does not need to be manually wiped or sprayed onto the tamping head, leading to less contact with a user's skin. A user's exposure to potentially harmful vapors of a fluid that is sprayed on the tamping head also is reduced. Some release agents are flammable, have harmful vapors, or are otherwise hazardous to users.

Furthermore, the embodiments disclosed herein provide for a cleaner worksite. Less of the fluid is spilled, which can benefit the environment. For example, less fluid may be spilled outside of the asphalt, such as on a lawn, in a flower bed, or near waterways.

Although the present disclosure has been described with respect to one or more particular embodiments, it will be understood that other embodiments of the present disclosure may be made without departing from the scope of the present disclosure. Hence, the present disclosure is deemed limited only by the appended claims and the reasonable interpretation thereof.

What is claimed is:

1. A hand tamper comprising:

a handle, wherein the handle defines a cavity, an inlet in fluid communication with the cavity, and an outlet in fluid communication with the cavity, wherein the inlet and the outlet are disposed on opposite ends of the handle;

a tamping head disposed on one of the ends of the handle, wherein the tamping head is in fluid communication with the outlet and includes:

a support member disposed on the handle, wherein the support member defines a bore configured to receive the handle; and a tamping plate disposed on the support member, wherein the tamping plate defines from two to six apertures through the tamping plate in fluid communication with the bore, wherein each of the apertures has a diameter from ⅛ inch to 5/32 inch; and a valve disposed in the handle, wherein the valve is configured to control fluid flowing from the cavity in the handle to the tamping head.

2. The hand tamper of claim 1, wherein the inlet is disposed on a proximal end of the handle and the outlet is disposed on a distal end of the handle, and wherein the cavity is disposed between the inlet and the outlet.

3. The hand tamper of claim 1, wherein the cavity is configured to hold at least a quart of fluid.

4. The hand tamper of claim 1, wherein the tamping head is fabricated entirely of aluminum, magnesium, cast iron, steel, or an alloy thereof.

5. The hand tamper of claim 1, wherein a seal is formed between the handle and the support member.

6. The hand tamper of claim 1, wherein the tamping plate defines four of the holes.

7. The hand tamper of claim 1, wherein at least part of an exterior surface of the tamping head includes a non-stick coating.

8. The hand tamper of claim 1, further comprising an activator connected to the valve, wherein the activator is disposed on the handle.

9. The hand tamper of claim 8, wherein the activator is disposed more proximate to the outlet of the handle than the inlet of the handle.

10. The hand tamper of claim 1, wherein the tamper head is configured to connect with the handle using a screw connection.

11. The hand tamper of claim 10, wherein the handle is configured to be disconnected from the tamping head.

* * * * *